United States Patent [19]

Sterman et al.

[11] 4,289,447

[45] Sep. 15, 1981

[54] METAL-CERAMIC TURBINE SHROUD AND METHOD OF MAKING THE SAME

[75] Inventors: Albert P. Sterman, Cincinnati; Charles H. Gay, Jr., Loveland; Frederick W. Tegarden; Dean T. Lenahan, and Martin C. Hemsworth, Cincinnati, all of Ohio

[73] Assignee: General Electric Company, Cincinnati, Ohio

[21] Appl. No.: 84,244

[22] Filed: Oct. 12, 1979

[51] Int. Cl.[3] ..... F01D 25/24; B32B 3/00

[52] U.S. Cl. ..... 415/200; 29/156.4 WL; 264/62; 264/81; 428/593; 428/598

[58] Field of Search ..... 415/200, 174; 428/593, 428/598; 264/60, 62, 81; 29/156.4 WL

[56] References Cited

U.S. PATENT DOCUMENTS

| | | | |
|---|---|---|---|
| 3,053,694 | 9/1962 | Daunt et al. | 415/174 X |
| 3,126,149 | 3/1964 | Bowers, Jr. et al. | 415/174 |
| 3,339,933 | 9/1967 | Foster | 277/53 |
| 3,519,282 | 7/1970 | Davis | 277/230 |
| 3,843,278 | 10/1974 | Torell | 415/174 |
| 3,975,165 | 8/1976 | Elbert et al. | 428/550 |
| 4,087,199 | 5/1978 | Hemsworth et al. | 415/174 |

OTHER PUBLICATIONS

Shiembob, L. T. *Development of a Plasma Sprayed Ceramic Gas Path Seal for High Pressure Turbine Applications,* NTIS N77-25534, Apr. 1977, p. (i 1-8, 55).

*Primary Examiner*—Leonard E. Smith

*Attorney, Agent, or Firm*—Carl L. Silverman; Derek P. Lawrence

[57] ABSTRACT

A turbine shroud includes a ceramic sealing layer secured to a metal substrate. In one form, the metal substrate includes a plurality of pegs extending therefrom. Intermediate bonding layers are disposed on the peg-metal substrate structure. A ceramic sealing layer of zirconium oxide with about 20 weight percentage magnesium oxide is disposed, e.g., plasma sprayed, on the intermediate bonding layers. The ceramic sealing layer includes an ordered pattern of very fine cracks therein which reduce the thermal stress in the ceramic sealing layer. A method of constructing a turbine shroud structure is also disclosed.

14 Claims, 12 Drawing Figures

METAL-CERAMIC TURBINE SHROUD AND METHOD OF MAKING THE SAME

BACKGROUND OF THE INVENTION

The present invention relates to turbine shrouds, and more particularly, to a metal-ceramic turbine shroud.

Turbine shrouds of all-metal construction have been widely employed. However, the effective life of such all-metal turbine shrouds is limited due to excessive oxidation and erosion caused by exposure to the high velocity hot gas stream in a turbine engine. As a result of this shroud material loss, clearances increase between rotor blade tips and the now-receding shroud. These increased clearances cause performance degradation due to lower efficiency. In addition, these increased clearances reduce the life of hot parts in the engine due to the higher gas temperatures needed to deliver constant thrust and also due to temperature overshoots.

It would appear that ceramic materials would offer potential advantages over metals in such hot shroud applications due to the superior oxidation and erosion resistance of ceramic materials with respect to metals. However, attempts to utilize ceramics have encountered severe problems. Such problems include: attachment stresses in the brittle ceramics; conduction of excessive heat through the ceramic; fabrication problems, e.g., high cost, low yield, due to the ceramics' extreme hardness and tendency to crack or chip; and material flaws that are very difficult to inspect.

It is, therefore, an object of the present invention to provide an improved turbine shroud structure.

Another object of the present invention is to provide such a turbine shroud structure which is a composite metal-ceramic structure providing desirable structural features of metal shrouds with desirable environmental resistance features of ceramics.

SUMMARY OF THE INVENTION

In one form of our invention, we provide a turbine shroud structure of the type having a metal substrate and a ceramic sealing layer secured thereto through mechanical matrix bonding means disposed between the metal substrate and the ceramic sealing layer. The mechanical matrix bonding means bonds the ceramic sealing layer to the metal substrate with the ceramic sealing layer including an ordered pattern of very fine cracks which reduce the thermal stress in the ceramic sealing layer.

In another form of our invention, we provide a method of constructing the turbine shroud structure. The method includes the steps of providing a metal substrate and providing the metal substrate with mechanical matrix bonding means having a predetermined spatial configuration. Then, a ceramic sealing layer is applied to the mechanical matrix bonding means and the ceramic sealing layer is caused to develop an ordered pattern of very fine cracks therein which reduce the thermal stress in the ceramic sealing layer.

BRIEF DESCRIPTION OF THE DRAWINGS

While the specification concludes with the claims particularly pointing out and distinctly claiming that which is regarded as the present invention, the objects and advantages of this invention can be more readily ascertained from the following description of preferred embodiments, when read in conjunction with the accompanying drawings in which:

FIG. 3A represents the turbine shroud structure shown in FIGS. 1 and 2B. FIG. 3B represents the turbine shroud structure shown in FIGS. 1 and 2C.

DESCRIPTION OF THE PREFERRED EMBODIMENT

Figure 1:
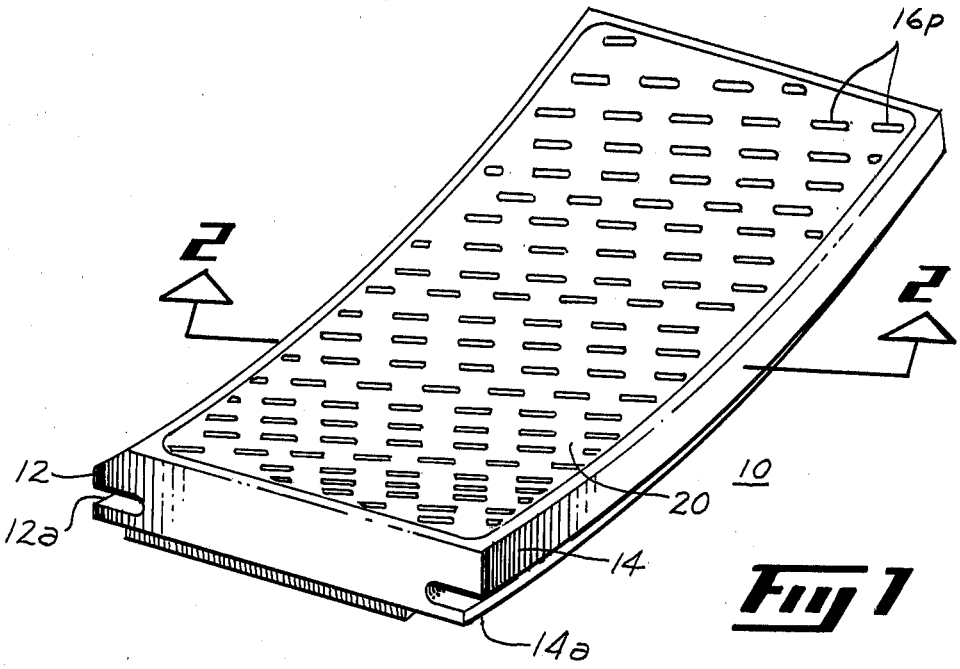
FIG. 1 is an isometric view showing one form of turbine shroud structure to which the present invention relates.

Referring initially to FIG. 1, one form of turbine shroud structure of the present invention is generally designated 10. The turbine shroud structure 10 includes a pair of opposing flanges 12, 14 which define grooves **12*a*, 14*a* which are suitable for use in attaching the turbine shroud 10 to a turbine shroud support assembly which may be somewhat similar to the one shown in U.S. Pat. No. 3,825,364, entitled "Porous Abradable Turbine Shroud," issued July 23, 1974, to Halila and Sterman. The turbine shroud 10 includes a metal substrate 16 with mechanical matrix bonding means which may be in the form of a plurality of pegs 16*p* extending away from the metal substrate 16 and toward the blade-receiving surface of the shroud. As shown more clearly in FIG. 2A, such pegs 16*p* may comprise an extension of the metal substrate 16. Exemplary materials for the metal substrate 16 and peg 16*p*** include: nickel base Rene'77; cobalt base M-509 or X-40.

Figure 2A:
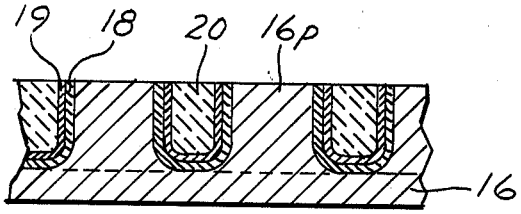
FIGS. 2A–2C are sectional side views, taken along line 2—2 of FIG. 1, respectively showing portions of several different forms of the present invention which employ mechanical matrix bonding means in the form of pegs.

Referring to FIG. 2A, first intermediate bonding layer 18, e.g., about 0.005 to 0.010 inches in thickness, is disposed, e.g., flame sprayed, on the metal substrate 16 and partially fills the spaces created by the pegs **16*p*. An exemplary intermediate bonding layer 18 may comprise a nickel chrome alloy commonly known as NiCrAlY, e.g., 95–100% density NiCrAlY. A second intermediate blend layer 19, e.g., about 0.004 to about 0.006 inches in thickness, may be disposed, e.g., flame sprayed, on the first intermediate bonding layer 18. A ceramic sealing layer 20 is disposed, e.g., plasma sprayed or sintered, on top of the second intermediate bonding layer 19. The relative dimensions of the pegs 16***p*, intermediate layers 18, 19, and the ceramic sealing layer are selected such that the pegs 16*p* extend at least partially through the ceramic sealing layer 20. In FIG. 2A, the pegs 16*p* extend substantially through the ceramic sealing layer 20.

The ceramic sealing layer 20 preferably comprises either zirconium oxide or zirconium phosphate. In connection with the use of zirconium oxide, it has been found that it is preferable to employ modifiers. For example, zirconium oxide may be modified with about 6 to about 25 weight percentage magnesium oxide or may be modified with about 6 to 25 weight percentage yttrium oxide. With respect to zirconium phosphate, modifiers may also be employed. For example, preferable materials include zirconium phosphate modified with about 33 to 100 weight percentage with materials such as mono-aluminum phosphate, phosphoric acid, yttrium oxide, magnesium oxide, silicon carbide whiskers, graphite.

In one exemplary shroud structure 10, the metal substrate 16 has a thickness of about 0.050 inches with pegs 16*p* extending an additional 0.100 inches. Preferably, the ceramic sealing layer 20 has a thickness of between about 0.035 to 0.040 inches. In such a configuration, the pegs 16*p* may be in the form of rectangular pegs, as shown in FIGS. 1 and 2A, in which each peg 16*p* has a length of about 0.105 inches, a width of about 0.050 inches, with the pegs 16*p* being disposed in rows and columns about 0.200 inches to 0.250 inches apart.

Referring again to FIGS. 1 and 2A, it is to be noted that, in this form of the present invention, the intermediate bonding layer 19 preferably comprises a blend of the materials in the bonding layer 18 and in the ceramic sealing layer 20. For example, in the case of a NiCrAlY bonding layer 18 and a zirconium oxide with magnesium oxide ceramic sealing layer 20, a preferable blend composition would comprise about: 50% NiCrAlY/50% zirconium oxide modified with magnesium oxide.

Figure 2B:
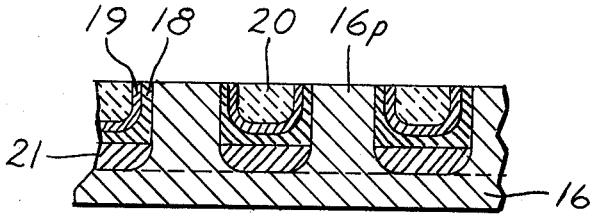

The peg bonding configuration shown in FIGS. 1 and 2B, is similar to the configuration discussed above in connection with FIGS. 1 and 2A so that like reference numerals have been employed to represent like elements. However, the structure of FIGS. 1 and 2B includes an additional intermediate layer disposed between the ceramic sealing layer and the metal substrate. More particularly, a filler layer 21, e.g., about 0.065 inches in thickness, of a material such as low density NiCrAlY, e.g., about 75–85% density, is disposed between the metal substrate 16 and the intermediate bonding layer 18. The filler layer 21 provides a cushion effect to the shroud structure.

Figure 2C:
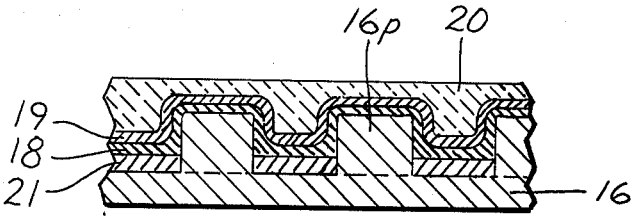

Referring now to FIGS. 1 and 2C, another similar form of peg bonding configuration is shown. In this form of the present invention, however, the pegs 16*p* are shorter than the pegs 16*p* of FIG. 2B such that the pegs 16*p* of FIG. 2C do not extend to the outer surface of the ceramic sealing layer 20. The peg bonding structure of FIG. 2C may be conveniently referred to as "buried peg."

Figure 3A:
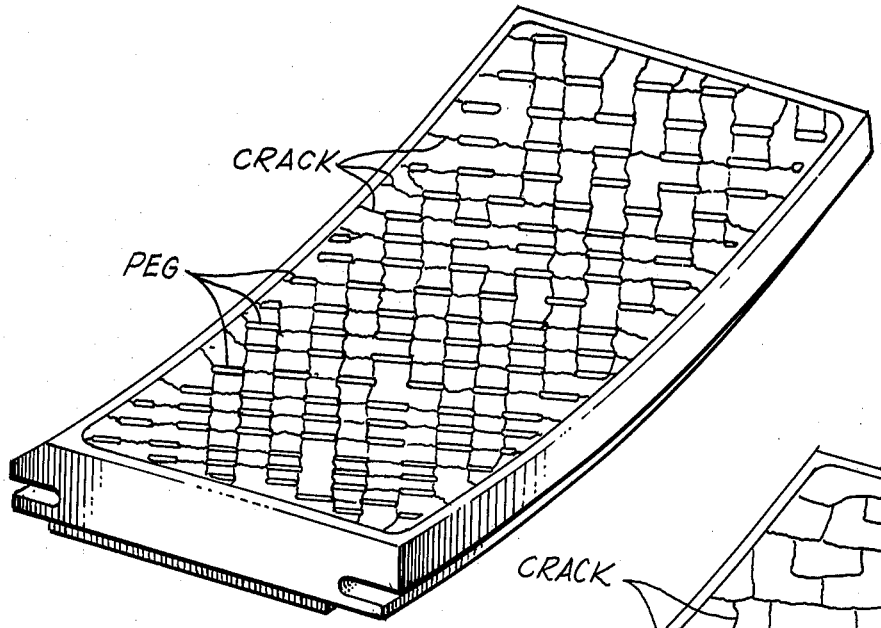
FIGS. 3A and 3B are representations of photographs of the turbine shroud structure of FIG. 1 showing the ceramic sealing surface thereof having an ordered pattern of very fine cracks therein.
Figure 3B:
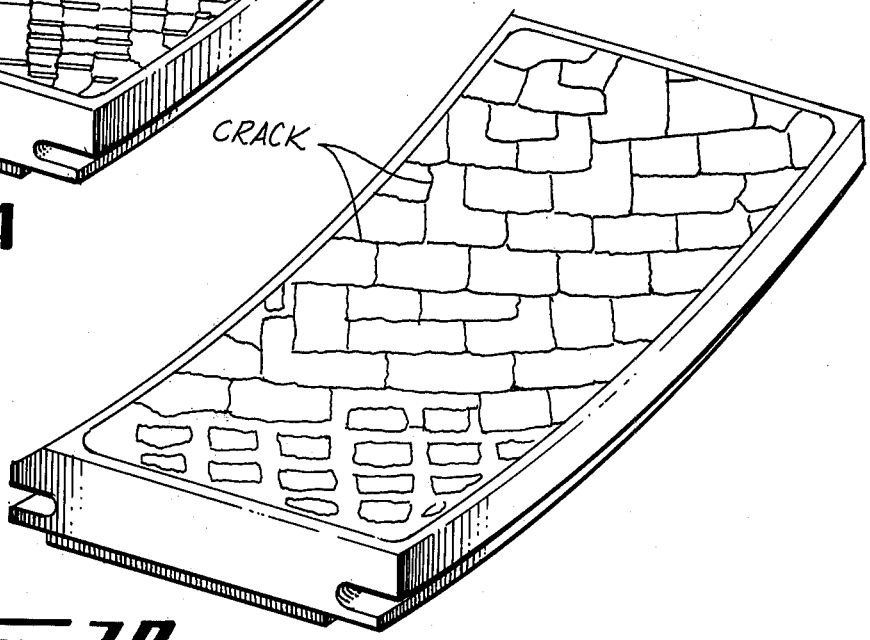

An advantage of the turbine shroud 10, of FIGS. 1 and 2A–2C, is that the ceramic sealing layer 20 includes an ordered pattern of very fine cracks which reduce the thermal stress in the ceramic sealing layer. Referring now to FIGS. 3A and 3B, the ceramic sealing layer 20 of the turbine shroud 10 of FIG. 1 is shown. More particularly, FIG. 3A represents a photograph of the structure shown in FIGS. 1 and 2B, and FIG. 3B represents a photograph of the structure shown in FIGS. 1 and 2C. It can be observed that the ceramic sealing surfaces include such an ordered pattern of very fine cracks. We have found that such ordered pattern is repeatable when the same shroud 10 is constructed. Such very fine cracks can be further described as having a crack width of about 0.001 to 0.003 inches, a spacing of about 0.150 inches, with the cracks being generally equally spaced.

Figure 5:
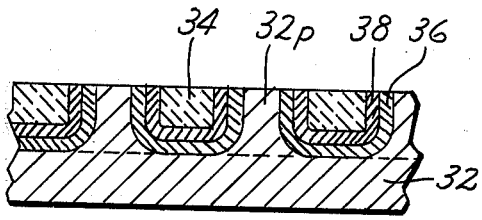
FIG. 5 is a portion of a sectional side view taken along line 5—5 of FIG. 4.
Figure 4:
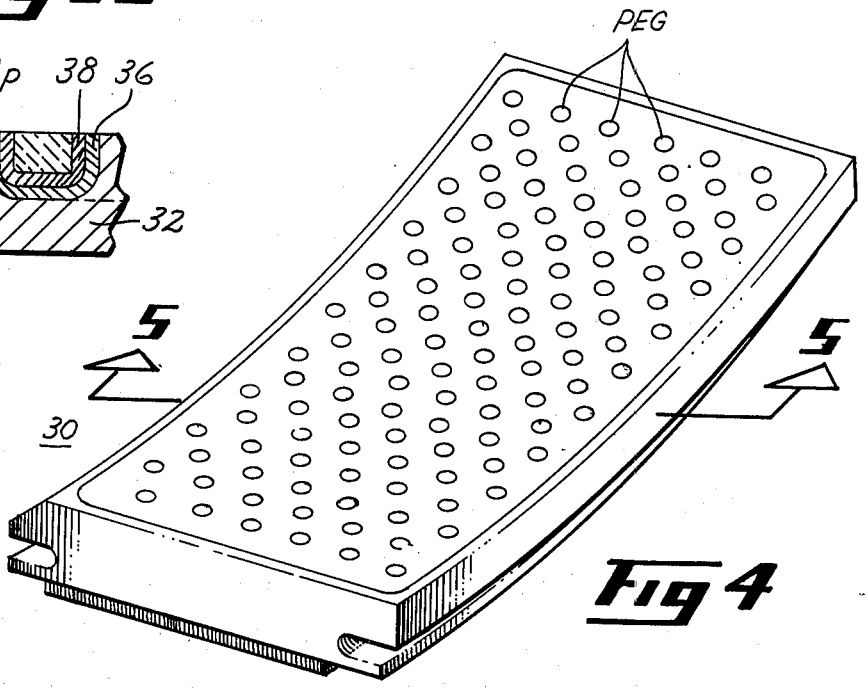
FIG. 4 is an isometric view showing another form of turbine shroud structure to which the present invention relates. This form of turbine shroud structure may be conveniently referred to as "super peg."
Figure 6:
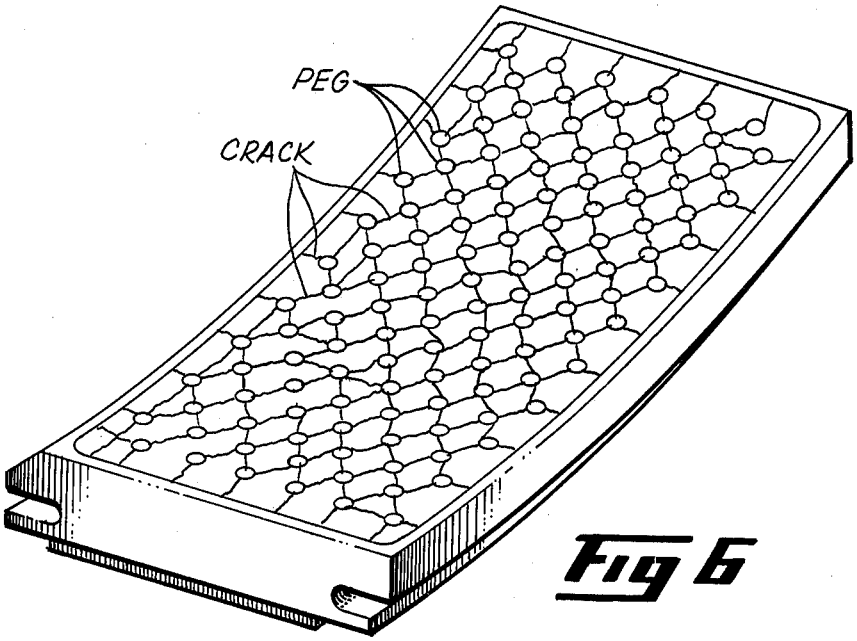
FIG. 6 is a representation of a photograph of the turbine shroud structure of FIGS. 4 and 5 showing the ceramic sealing surface thereof having an ordered pattern of very fine cracks therein.

Referring now to FIGS. 4 and 5, another form of turbine shroud structure to which the present invention relates is generally designated 30. The shroud structure 30 of FIGS. 4 and 5 is similar in many respects to the shroud structure 10 of FIGS. 1 and 2A–2C. The turbine shroud structure 30 also includes a metal substrate 32 with a plurality of pegs 32*p* extending therefrom. However, the pegs 32*p* of shroud 30 are smaller and more closely spaced than the corresponding pegs 16*p* of FIGS. 1 and 2A–2C. For example, such pegs 32*p* may comprise circular 0.040 inch diameter pegs equally spaced on three times diameter spacing. An advantage of this smaller peg, closer spacing configuration (sometimes referred to as "super peg") as compared to the shroud structure 10 of FIGS. 1 and 2A–2C is that the structure 30 provides an ordered pattern of even finer cracks than the corresponding cracks of the shroud structure 10. As pointed out earlier, these fine cracks reduce the thermal stress in the ceramic sealing layer. Typical crack numbers and crack dimensions in this shroud structure 30 are about 0.001 to 0.003 inch crack width with a uniform spacing of about 0.080 inches. FIG. 6 is a representation of a photograph of the ceramic sealing layer 34 of the shroud structure 30, showing such fine cracks.

The shroud structure 30 also includes a ceramic sealing layer 34 which may be, for example, joined to the metal substrate 32 in a manner similar to that shown in FIGS. 1 and 2A. More particularly, the ceramic sealing layer 34 may be joined to the metal substrate 32 through a bond layer 36 and intermediate blend layer 38, where layer 36 corresponds to bond layer 18 of FIG. 2A and layer 38 corresponds to intermediate blend layer 19 of FIG. 2A. An exemplary material for bonding layer 36 is NiCrAlY, e.g., 95–100% density. Intermediate blend layer 38 may comprise a blend composition of the ceramic sealing layer 34 with a material such as NiCrAlY, e.g., 50% $ZrO_2$/50% NiCrAlY.

Exemplary dimensions for the shroud structure 30 of FIGS. 4 and 5 ("super peg") are: about 0.005 to 0.010 inches thickness for bond layer 36; about 0.004 to 0.006 inches for blend layer 38; about 0.035 to 0.040 inches for ceramic sealing layer 34.

Figure 7A:
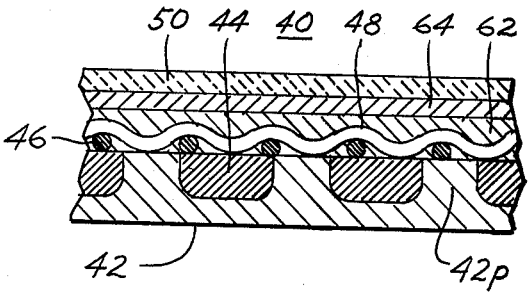
FIGS. 7A and 7B are portions of sectional views, taken as in FIGS. 2A–2C, showing another form of turbine shroud structure to which the present invention relates. In this form of the present invention, the mechanical matrix bonding means includes wire mesh.

Referring now to FIG. 7A, a portion of another form of turbine shroud structure to which the present invention relates is generally designated 40. In the shroud structure 40, metal pegs 42*p* extend from a metal substrate 42. The space between the metal pegs 42*p* is provided with a filler layer 44 of a material such as low density, NiCrAlY, e.g., 75–85%. Then, the structure is provided with wire mesh by brazing a first plurality of wires 46 to the pegs 42*p* and to filler layer 44. Then a second plurality of wires 48 may be secured by weaving and brazing to the first plurality of wires 46. Preferably, bond layer 62 and blend layer 64 are also employed. In this form of the present invention, the bonding includes the cooperation of mesh and peg structures. Typically, the wires in the resulting mesh 46–48 have a diameter of about 0.020 to 0.030 inches. A ceramic sealing layer 50 is then disposed on the wire mesh 46–48, layer 62, 64 structure.

Exemplary dimensions for the shroud structure 40 of FIG. 7A are: about 0.030 to 0.040 thickness for ceramic sealing layer 50; about 0.020 to 0.030 inches for filler layer 44.

Figure 7B:
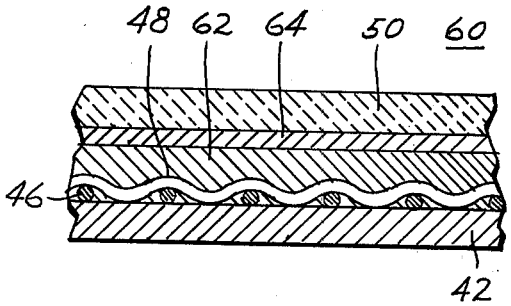

Another form of wire mesh structure suitable for use in the turbine shroud structure of the present invention is shown in FIG. 7B and is generally designated 60. The structure 60 of FIG. 7B is similar to the structure 40 of FIG. 7A so that, where possible, like reference numerals have been employed to represent like elements. An important difference between shroud structures 40 and 60 is that shroud structure 60 includes wire mesh 46 and 48 joined to metal substrate 42 wherein metal substrate 42 includes no pegs 42*p* extending therefrom. As shown in FIG. 7B, the structure 60 preferably includes intermediate bonding layers 62 and 64 wherein bond layer 62 corresponds to previously discussed bond layer 18 of FIGS. 2A–2C and bond layer 36 of FIG. 5 and wherein blend layer 64 corresponds to blend layer 19 of FIGS. 2A–2C and blend layer 38 of FIG. 5.

Figure 8:
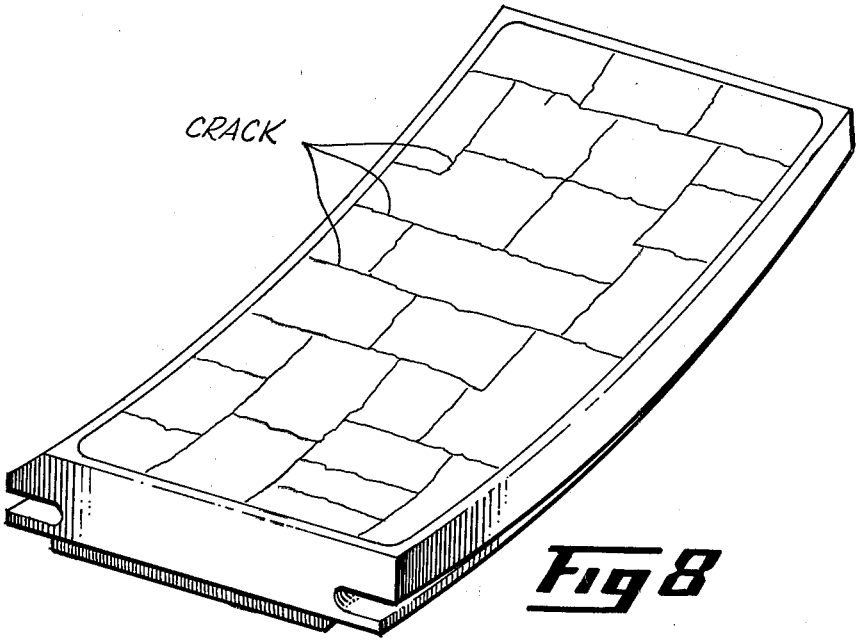
FIG. 8 is a representation of a photograph of the turbine shroud structure of FIG. 7A showing the ceramic sealing layer thereof having an ordered pattern of very fine cracks therein.

An advantage of the wire mesh mechanical matrix bonding shown in FIGS. 7A and 7B is that such structure fulfills the purpose of the mechanical matrix bonding to capture the ceramic sealing layer and to hold such layer intact. In addition, such wire mesh provides for the crack pattern in the ceramic sealing layer which relieves thermal stresses, but retains cracked ceramic particles. FIG. 8 is a representation of a photograph of the ceramic sealing layer 50 of FIG. 7A, showing the ordered pattern of fine cracks therein.

Further, the wire mesh provides local bonding to the shroud structure but provides space for the ceramic sealing layer. Also, in the wire mesh structure of FIGS. 7A and 7B, the local wire bonding to the shroud structure and the reduced surface exposure of the wire mesh keeps the shroud structure temperature relatively low due to reduced heat conduction. Generally, the particular wire mesh geometry is chosen with regard to the composition of the ceramic sealing layer. For example, materials suitable for the wire mesh 46 and 48 include those commercially available as L605; Inconel 600; Hastalloy X. Variations available in the wire geometry include the wire diameter and the mesh size, i.e., the openings between the wires. In addition, various weave patterns may be employed. For example, such weaves may include: a rectangular cloth weave; chain link weave, knitted single wire weave; corrugation of weaves for height and sizing; spiral weave for spring tendency; and an intercrimp weave for added wire cloth flexibility.

With respect to the various forms of shroud structure of the present invention, it is to be appreciated such forms may have particular advantages. For example, in the form in which pegs are recessed below the outer surface of the ceramic sealing layer, there is reduced heat conduction along the pegs, resulting in a lower maximum peg temperature. In addition, no peg-blade contact occurs during rubbing, resulting in less blade tip wear. In the form of pegs extending through, but not beyond, the ceramic sealing layer, the pegs provide a maximum gripping depth to the ceramic sealing layer. In the form of wire mesh recessed below the outer surface of the ceramic sealing layer, there is a great interlock of the ceramic sealing layer to the mesh. Also, no mesh-blade contact occurs during rubbing, and there is a lower maximum mesh temperature due to the insulation provided by the ceramic sealing layer.

With respect to the use of zirconium oxide modified with magnesium oxide, in some cases it may be desirable to heat treat the shroud in order to improve the rub wear and thermal stress characteristics of the ceramic sealing layer. Such heat treatment is more fully described in copending patent application, Ser. No. 084,243, of C. L. Ammann, entitled "Method For Constructing A Turbine Shroud," filed concurrently herewith, and hereby incorporated into reference in the present application.

Although the turbine shroud structures of the present invention have hereinbefore been discussed in connection with pegs and wire mesh, other forms of mechanical matrix bonding may be provided. For example, other forms of mechanical matrix bonding include: tapered pegs; undercut pegs; chain link structures; honeycomb structures; as well as combinations thereof. Also, although it is preferable to include at least one intermediate bonding layer between the ceramic sealing layer and the metal substrate, satisfactory results may be obtained without employing all of the intermediate layers discussed hereinbefore. In this connection, satisfactory results may be obtained by employing two intermediate bonding layers which comprise a first layer, such as the previously discussed 95–100% density NiCrAlY, and a second intermediate bonding layer, such as the previously discussed blend of NiCrAlY and ceramic. For some applications, a single intermediate bonding layer may be appropriate.

While the present invention has been described with reference to specific embodiments thereof, it will be obvious to those skilled in the art that various changes and modifications may be made without departing from the invention in its broader aspects. It is contemplated in the appended claims to cover all such variations and modifications of the invention which come within the true spirit and scope of our invention.

What is claimed as new and desired to be secured by Letters Patent of the United States is:

1. A turbine shroud structure of the type having a metal substrate and a ceramic sealing layer secured thereto, wherein the improvement comprises:

mechanical matrix bonding means disposed between said metal substrate and said ceramic sealing layer and bonding said ceramic sealing layer to said metal substrate with said ceramic sealing layer including an ordered pattern of very fine cracks which reduce the thermal stress in said ceramic sealing layer.

2. A turbine shroud structure in accordance with claim 1 in which said ceramic sealing layer comprises a ceramic selected from the group consisting of zirconium oxide and zirconium phosphate.

3. A turbine shroud structure in accordance with claim 2 including at least one intermediate layer disposed between said metal substrate and said ceramic sealing layer.

4. A turbine shroud structure in accordance with claim 3 in which said mechanical matrix bonding means comprises a plurality of pegs extending from said metal substrate.

5. A turbine shroud structure in accordance with claim 4 in which said pegs extend at least partially through said ceramic sealing layer.

6. A turbine shroud structure in accordance with claim 3 in which said mechanical matrix bonding means comprises wire mesh.

7. A turbine shroud structure in accordance with claim 6 in which said mechanical matrix bonding means comprises a plurality of pegs cooperating with said wire mesh.

8. A turbine shroud structure in accordance with claim 3 in which said ceramic sealing layer has a thickness of between about 0.035 to 0.040 inches.

9. A turbine shroud structure in accordance with claim 8 in which said ceramic sealing layer comprises zirconium oxide with about 6 to 25 weight percentage magnesium oxide.

10. A turbine shroud structure in accordance with claim 8 in which said ceramic sealing layer comprises zirconium oxide with about 6 to 25 weight percentage yttrium oxide.

11. A turbine shroud structure in accordance with claim 8 in which said ceramic sealing layer comprises zirconium phosphate.

12. A method of constructing a turbine shroud structure, comprising the steps of:

(a) providing a metal substrate;

(b) providing said metal substrate with mechanical matrix bonding means having a predetermined spatial configuration, and then (c) applying a ceramic sealing layer to said mechanical matrix bonding means and causing said ceramic sealing layer to develop an ordered pattern of very fine cracks therein which reduce the thermal stress in said ceramic sealing layer.

13. A method in accordance with claim 12 in which said ceramic sealing layer comprises a ceramic selected from the group consisting of zirconium oxide and zirconium phosphate.

14. A method in accordance with claim 13 in which said ceramic sealing layer comprises zirconium oxide modified with about 6 to 25 weight percentage magnesium oxide.

* * * * *